US006590993B2

(12) United States Patent
D'Hoogh et al.

(10) Patent No.: US 6,590,993 B2
(45) **Date of Patent: *Jul. 8, 2003**

(54) PANEL-SHAPED LOUDSPEAKER

(75) Inventors: Guido O. M. D'Hoogh, Dendermonde (BE); David M. E. Corynen, Berchem (BE)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/417,537

(22) Filed: Oct. 14, 1999

(65) Prior Publication Data

US 2002/0196961 A1 Dec. 26, 2002

(30) Foreign Application Priority Data

Sep. 6, 1999 (EP) ..... 99202868

(51) Int. Cl.[7] ..... H04R 25/00

(52) U.S. Cl. ..... 381/431; 381/425; 381/423; 381/162; 181/293; 181/292; 181/288; 181/169; 181/173; 181/167

(58) Field of Search ..... 381/353, 162, 381/423, 425, 431; 181/161, 164–166, 292, 293, 288, 173, 169

(56) References Cited

U.S. PATENT DOCUMENTS

| | | | | |
|---|---|---|---|---|
| 3,247,925 A | * | 4/1966 | Warnaka | |
| 4,198,550 A | * | 4/1980 | Matsuda | |
| 4,300,655 A | * | 11/1981 | Sakamoto | |
| 4,512,435 A | | 4/1985 | Takeuchi et al. | 181/170 |
| 4,582,163 A | * | 4/1986 | Catthoor | |
| 4,961,227 A | * | 10/1990 | Le Donne | |
| 5,022,943 A | * | 6/1991 | Zaima | |
| 5,297,214 A | * | 3/1994 | Bruney | |
| 5,545,861 A | * | 8/1996 | Morimoto | |

FOREIGN PATENT DOCUMENTS

| | | | |
|---|---|---|---|
| WO | WO9709842 | 3/1997 | H04R/1/02 |
| WO | 9967974 A1 | 12/1999 | |

* cited by examiner

*Primary Examiner*—Rexford Barnie
*Assistant Examiner*—Dionne N. Harvey
(74) *Attorney, Agent, or Firm*—Steven R. Biren

(57) ABSTRACT

A panel-shaped loudspeaker includes a panel (1) and an exciter coupled to the panel. The panel is provided with two parallel extending thin walls (1*a*, 1*b*) which are interconnected by a structure of thin strip-shaped partitions (1*c*) situated between the walls. The longitudinal axes of all partitions extend parallel to each other and give the panel an anisotropic bending stiffness. The material of the walls and the partitions of the panel has an internal damping which is at least 2.5% of the critical damping of the relevant material, used in the panel.

26 Claims, 2 Drawing Sheets

PANEL-SHAPED LOUDSPEAKER

BACKGROUND OF THE INVENTION

1. Field of the Invention

This invention relates to a panelshaped loudspeaker comprising a panel and at least an exciter coupled to the panel, said panel being provided with two, at least substantially parallel, interconnected walls.

2. Description of The related Art

A loudspeaker of this type is known from PCT Patent Application WO-A 97/09842.

The known panel-shaped loudspeaker comprises a panel having a sandwich-like structure and a rigid cellular core such as a honeycomb structure, and two skins glued to the core, the core extends extending the skins. A light metal and a synthetic material are used as materials for the core. Paper, cardboard, synthetic material and light metal are mentioned as materials for the skins. The omni-sided relatively rigid lightweight panel exhibits usable patterns of bending waves only at relatively high frequencies. In the known loudspeaker, one or more exciters are used which are arranged with respect to the panel in such a way that bending waves are produced only at relatively high frequencies. Due to reflections on the edges of the panel, bending waves which interfere with each other are spread across the panel. The known loudspeaker has a poor acoustical behavior in the low-frequency range.

SUMMARY OF THE INVENTION

It is an object of the invention to provide a panel-shaped loudspeaker which has a satisfactory acoustical behavior, both at relatively low frequencies and at higher frequencies.

This object is achieved with the loudspeaker according to the invention, which is characterized in that the panel comprises a structure of strip-shaped partitions extending between the walls of the panel, the longitudinal axes of all of said partitions mutually extending at least parallel to each other and parallel to the walls, said partitions being further secured to the walls, the walls and the partitions being made of a material which, used in the panel, has an internal damping which is at least 2.5% of the critical damping of the relevant material, used in the panel. Critical damping is herein understood to mean that damping at which the oscillating character of the panel stops.

Mechanically, the panel of the loudspeaker according to the invention is anisotropic, the panel being bendable around an axis extending parallel to said longitudinal axes and being relatively bending-stiff about an axis oriented transversely thereto. Surprisingly, it has been found that the loudspeaker according to the invention has a favorable acoustical behavior, both at low frequencies, central frequencies and high frequencies. It has been found, by experiments, that natural resonances already occur at relatively low frequencies in the panel of the loudspeaker according to the invention, these resonances having a smaller amplitude only at natural resonances occurring at relatively high frequencies, as compared with the loudspeaker known from said WO-A 97/09842. It is preferable not to exceed an internal damping of maximally 10% so as to avoid negative effects possibly occurring with larger dampings at higher frequencies. A very favorable acoustical behavior through a wide frequency range was found at an internal damping of 3% of the critical damping.

An embodiment of the loudspeaker according to the invention is characterized in that the partitions mutually extend at least substantially parallel to each other and are at least substantially perpendicular to the walls for achieving an optimal anisotropy.

A practical embodiment of the loudspeaker according to the invention is characterized in that the material of the walls is equal to the material of the partitions. A further embodiment is characterized in that the walls and partitions blend seamlessly. In this embodiment, the walls and partitions constitute an integral unit manufactured, for example, by means of extrusion. Such a panel is obtainable in a simple manner and at low cost.

An embodiment of the loudspeaker according to the invention is characterized in that the material of the walls and the partitions of the panel is a polypropylene. The polypropylene is preferably a co-polymer.

An extruded, twin-walled plate of polypropylene co-polymer suitable as a loudspeaker panel is commercially available. Measurements proved that this material had an internal damping of 2.9% of the critical damping factor of the relevant material.

These and other aspects of the invention are apparent from and will be elucidated with reference to the embodiments described hereinafter.

DESCRIPTION OF THE PREFERRED ENBODIMENTS

Figure 1:
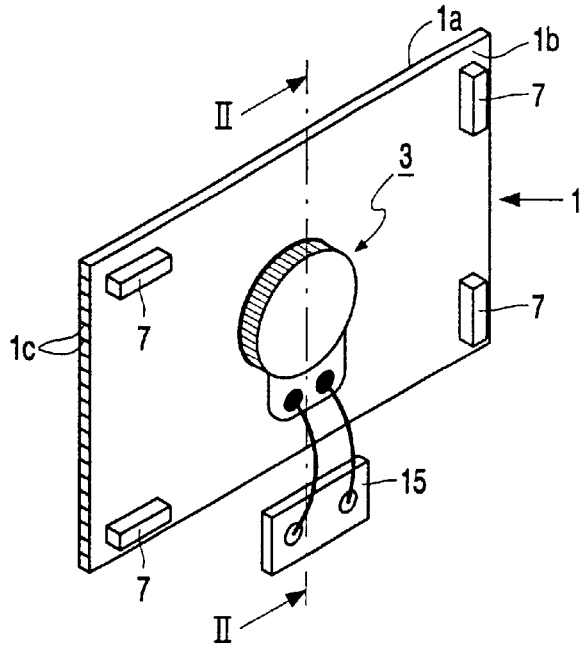
FIG. 1 is a diagrammatic rear view of an embodiment of the panel-shaped loudspeaker according to the invention.
Figure 2:
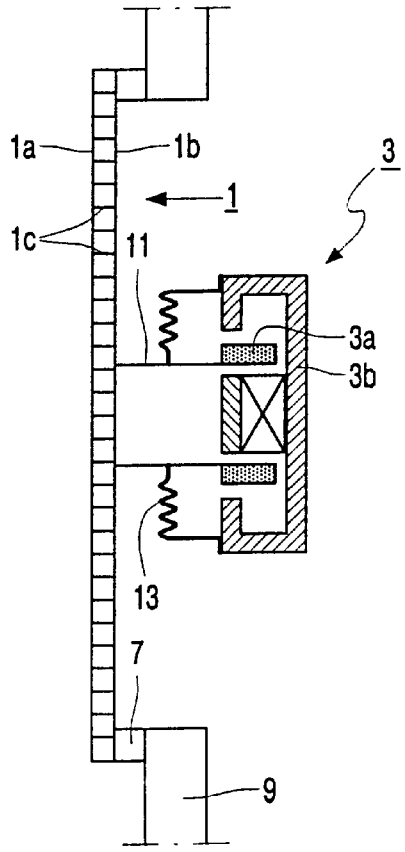
FIG. 2 shows diagrammatically the embodiment shown in FIG. 1 (secured to a frame) in a cross-section taken on the line II—II in FIG. 1.
Figure 3:
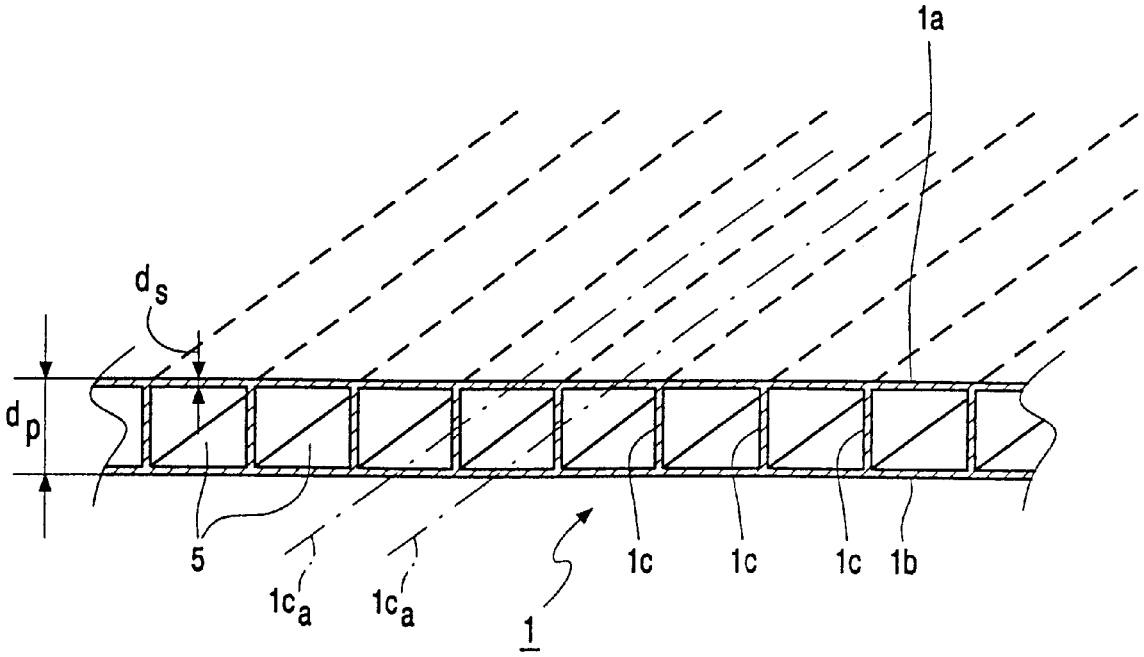
FIG. 3 shows diagrammatically in a cross-section taken on the line II—II in FIG. 2, a part of the panel of the embodiment on a larger scale.

The panel-shaped loudspeaker according to the invention, shown in the Figures, comprises a panel 1, particularly a flat panel, and an exciter 3 coupled to the panel 1. The panel 1 comprises two thin walls or main walls 1*a* and 1*b*, and a structure of thin strip-shaped partitions 1*c* situated between the two walls 1*a* and 1*b* and interconnecting the walls 1*a* and 1*b*.

The partitions 1*c* are oriented transversely to the walls 1*a* and 1*b* and the longitudinal axes $1c_a$ of all of these partitions extend parallel to each other and parallel to the walls 1*a* and 1*b*. In this embodiment, the walls 1*a* and 1*b* and the partitions 2*c* form one product, notably an extrusion product, formed from a polypropylene co-polymer. In the application shown, this material has an internal damping of 2.9%. In this embodiment, the panel 1 has a thickness $d_p$ of 1.5 mm and the walls 1*a* and 1*b* and partitions 1*c* have a thickness $d_s$ of 0.3 mm.

In this embodiment, the walls 1*a* and 1*b* together with the partitions 1*c* constitute parallel channels 5 having a rectangular, substantially square, cross-section. The panel 1 has an anisotropic bending stiffness. If additional damping is desired, a damping material, such as a polyurethane foam, may be selectively provided in the channels.

In this embodiment, the panel 1 is secured to a frame 9 by means of resilient securing means 7. In this embodiment, the exciter 3 is provided with an electromagnetic exciter system comprising an exciter coil 3*a* on a coil former 11 secured to the panel 1, and a magnetic unit 3*b* co-operating therewith through an air gap. The magnetic unit 3*b* comprises a permanent magnet and a magnetic yoke and is suspended to the coil former 11 by means of a resilient suspension means 13. The exciter 3 is also provided with electrical connection means 15.

It is to be noted that the invention is not limited to the shown embodiment of the panel-shaped loudspeaker according to the invention. For example, several variations are possible within the scope of the invention, notably as regards dimensions and choice of material. It is essential that the panel of the loudspeaker according to the invention has two parallel walls which are interconnected by means of a structure of parallel strip-shaped partitions, while the material used has a sufficiently high damping factor. Furthermore, an exciter system of a different type, particularly of a piezoelectric type, may be used instead of an electromagnetic exciter system.

The loudspeaker according to the invention may be used in audio, video and multimedia systems. The loudspeaker may also be used as a car loudspeaker and as a conference loudspeaker.

What is claimed is:

1. A panel-shaped loudspeaker comprising: a panel and at least an exciter coupled to one main wall of the panel so as to excite a bending wave pattern in the panel, said panel including a second main wall with both walls being at least substantially parallel to each other and interconnected, characterized in that the panel comprises a structure of strip-shaped partitions extending between the main walls of the panel, said partitions having longitudinal axes extending at least parallel to each other and parallel to the main walls, said partitions being secured to the main walls, the main walls and the partitions of the panel being made of a material which has an internal damping which is at least 2.5% of the critical damping of the material, as used in the panel.

2. The panel-shaped loudspeaker as claimed in claim 1, characterized in that the partitions mutually extend at least substantially parallel to each other, and are at least substantially perpendicular to the two main walls.

3. The panel-shaped loudspeaker as claimed in claim 1, characterized in that the material of the main walls is the same as the material of the partitions.

4. The panel-shaped loudspeaker as claimed in claim 1, characterized in that the main walls and partitions blend seamlessly such that the loud speaker provides good acoustic performance throughout a range of frequencies including low frequencies and high frequencies.

5. The panel-shaped loudspeaker as claimed in claim 1, characterized in that material is a polypropylene material.

6. The panel-shaped loudspeaker as claimed in claim 5, characterized in that the polypropylene material is a co-polymer material.

7. A panel-shaped loudspeaker comprising: a panel and at least an exciter coupled to the panel, said panel including two, at least substantially parallel, interconnected walls, characterized in that the panel comprises a structure of strip-shaped partitions extending between the walls of the panel, said partitions having longitudinal axes extending at least parallel to each other and parallel to the walls, said partitions being secured to the walls, the walls and the partitions of the panel being made of a material which has an internal damping which is at least 2.5% of the critical damping of the material as used in the panel, wherein all of the partitions of the panel extend parallel to each other and to said walls of the panel.

8. The panel-shaped loudspeaker as claimed in claim 1 wherein said two parallel main walls are interconnected by at least two opposed sides of the panel.

9. The panel-shaped loudspeaker as claimed in claim 8 wherein all of said partitions extend between said two opposed sides of the panel to form respective continuous channels therebetween.

10. A panel-shaped loudspeaker comprising: a panel and at least an exciter coupled to the panel, said panel including two, at least substantially parallel, interconnected main walls, wherein the panel comprises a structure of strip-shaped partitions extending between the two main walls of the panel and secured to said walls, said partitions having longitudinal axes extending at least substantially parallel to each other and to the two main walls, the partitions and the walls constituting channels extending at least substantially parallel to each other and to the walls, and the partitions and the walls being made of a material which has an internal damping which is at least 2.5% of the critical damping of the material used in the panel.

11. The panel-shaped loudspeaker as claimed in claim 10 wherein all of the partitions of the panel extend parallel to each other and to said two main walls of the panel.

12. The panel-shaped loudspeaker as claimed in claim 10 wherein the longitudinal axes of all of the partitions of the panel extend parallel to each other and to said two main walls of the panel.

13. The panel-shaped loudspeaker as claimed in claim 10 wherein said two walls together with the partitions form rectangular parallel channels with a square cross-section and dimensioned such that the panel exhibits an anisotropic bending stiffness.

14. The panelshaped loudspeaker as claimed in claim 10 wherein said two walls together with the partitions form parallel channels and the walls and partitions are dimensioned such that the panel bends around an axis extending parallel to said longitudinal axes and is relatively bending stiff about an axis transverse thereto.

15. The panel-shaped loudspeaker as claimed in claim 10 wherein the material of the walls is the same as the material of the partitions and the two walls and the partitions constitute an integral unit whereby the loud speaker provides good acoustic performance throughout a range of frequencies including low frequencies and high frequencies.

16. The panel-shaped loudspeaker as claimed in claim 10 wherein said two walls together with the partitions form parallel channels which extend parallel to said two main walls of the panel so that the loud speaker provides good acoustic performance throughout a range of frequencies including low frequencies and high frequencies.

17. The panel-shaped loudspeaker as claimed in claim 10 wherein said internal damping is at most 10% of the critical damping of the material constituting the panel.

18. The panel-shaped loudspeaker as claimed in claim 10 wherein the exciter comprises an electromagnetic exciter system and the panel secured to a frame by resilient securing means.

19. The panelshaped loudspeaker as claimed in claim 10 wherein the partitions extend at least substantially parallel to each other an are at least substantially perpendicular to the walls.

20. The panel-shaped loudspeaker as claimed in claim 16 wherein said parallel channels form continuous channels that extend between parallel opposed sides of the panel perpendicular to and interconnecting the two main walls of the panel.

21. A panel-shaped loudspeaker comprising:

a panel including two parallel main walls interconnected by a structure of thin partitions extending between and secured to said two main walls of the panel, all of said partitions having longitudinal axes that extend parallel to each other and parallel to the two main walls of the panel so that the two main walls and the partitions form channels extending parallel to said longitudinal axes, wherein the partitions and the two main walls are made of a material which has an internal damping as used in the panel which is at least 2.5% of the critical damping of the material as used in the panel, and an exciter member coupled to the panel so as to produce a bending wave pattern in the panel when energized.

22. The panel-shaped loudspeaker as claimed in claim 21 wherein said two walls together with the partitions form parallel channels and the walls and partitions are dimensioned such that the panel is bendable around an axis extending parallel to said longitudinal axes and is relatively bending stiff about an axis transverse thereto, whereby the loud speaker provides good acoustic performance throughout a range of frequencies including low frequencies and high frequencies.

23. The panel-shaped loudspeaker as claimed in claim 21 wherein said internal damping is 3% of the critical damping of the material constituting the panel.

24. The panel-shaped loudspeaker as claimed in claim 21 wherein said two main walls together with the partitions forms rectangular parallel channels and the panel has a mechanical anisotropy.

25. The panel-shaped loudspeaker as claimed in claim 21 wherein the material comprises a polypropylene co-polymer material.

26. A panel-shaped loudspeaker comprising: a panel and at least one exciter coupled to a main wall of the panel for exciting a bending wave pattern in the panel, which panel includes a further main wall, both main walls being at least substantially parallel to each other, a structure of elongated strip-shaped partitions extending between the main walls and interconnecting said main walls, which partitions are secured to said main walls and have longitudinal axes extending at least substantially parallel to each other and parallel to the main walls, whereby the main walls and the partitions form channels extending parallel to said longitudinal axes, the main walls and the partitions being made of a material which has an internal damping, determined when the material is used in the panel, which internal damping is at least 2.5% of the critical damping of the material of at least the main walls and/or the partitions, determined when used in the panel.

* * * * *